US007934394B2

(12) United States Patent
Zhu

(10) Patent No.: US 7,934,394 B2
(45) **Date of Patent: *May 3, 2011**

(54) CUT-RESISTANT GLOVES CONTAINING FIBERGLASS AND PARA-ARAMID

(75) Inventor: Reiyao Zhu, Moseley, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 132 days.

This patent is subject to a terminal disclaimer.

(21) Appl. No.: 12/359,733

(22) Filed: Jan. 26, 2009

(65) Prior Publication Data

US 2010/0186455 A1 Jul. 29, 2010

(51) Int. Cl.
*D04B 7/34* (2006.01)

(52) U.S. Cl. ..... 66/174

(58) Field of Classification Search ..... 66/169 R, 66/170, 171, 196, 202, 174; 2/16
See application file for complete search history.

(56) References Cited

U.S. PATENT DOCUMENTS

| | | | | | |
|---|---|---|---|---|---|
| 2,929,801 | A | | 3/1960 | Koller | |
| 2,929,802 | A | | 3/1960 | Katz | |
| 2,929,803 | A | | 3/1960 | Frazer et al. | |
| 2,929,804 | A | | 3/1960 | Steuber | |
| 2,953,839 | A | | 9/1960 | Kohrn et al. | |
| 2,957,852 | A | | 10/1960 | Frankenburg et al. | |
| 2,962,470 | A | | 11/1960 | Jung | |
| 2,999,839 | A | | 9/1961 | Arvidson, Jr. et al. | |
| 3,009,901 | A | | 11/1961 | Frazer | |
| 3,490,224 | A | * | 1/1970 | Bourgeas | 57/210 |
| 3,767,756 | A | | 10/1973 | Blades | |
| 3,869,429 | A | | 3/1975 | Blades | |
| 3,869,430 | A | | 3/1975 | Blades | |
| 4,384,449 | A | * | 5/1983 | Byrnes et al. | 57/210 |
| 4,470,251 | A | * | 9/1984 | Bettcher | 57/230 |
| 4,838,017 | A | * | 6/1989 | Kolmes et al. | 57/210 |
| 4,936,085 | A | * | 6/1990 | Kolmes et al. | 57/229 |
| 5,119,512 | A | * | 6/1992 | Dunbar et al. | 2/167 |
| 5,177,948 | A | * | 1/1993 | Kolmes et al. | 57/229 |
| 5,628,172 | A | * | 5/1997 | Kolmes et al. | 57/210 |
| 5,845,476 | A | * | 12/1998 | Kolmes | 57/229 |

(Continued)

FOREIGN PATENT DOCUMENTS

| | | |
|---|---|---|
| WO | WO 98/55676 | 12/1998 |

*Primary Examiner* — Danny Worrell

(57) ABSTRACT

This invention relates to a cut-resistant knit glove comprising:

a) cut-resistant composite yarn having a core yarn and at least one first wrapping yarn helically wrapped around the core yarn, the core yarn including at least one 50 to 200 denier (56 to 220 dtex) glass fiber filament yarn and the first wrapping yarn being one 100 to 600 denier (110 to 680 dtex) para-aramid yarn;

b) companion yarn selected from the group consisting of aliphatic polyamide, polyester, and mixtures thereof; and c) lining yarn comprising a composite yarn of from 100 to 500 denier (110 to 560 dtex), the composite yarn having an elastomeric yarn core comprising at least one elastomeric yarn and at least one second wrapping yarn helically wrapped around the yarn core, the second wrapping yarn including at least one 20 to 300 denier (22 to 340 dtex) yarn selected from the group consisting of aliphatic polyamide, polyester, natural fibers, cellulosic fibers, and mixtures thereof;

wherein the cut-resistant composite yarn, the companion yarn, and the lining yarn are co-knit in the glove with the lining yarn plated on the interior of the glove and the cut-resistant composite yarn and companion yarn forming the exterior of the glove.

12 Claims, 2 Drawing Sheets

U.S. PATENT DOCUMENTS

| | | | | |
|---|---|---|---|---|
| 5,965,223 | A | 10/1999 | Andrews et al. | |
| 6,016,648 | A * | 1/2000 | Bettcher et al. | 57/230 |
| 6,044,493 | A | 4/2000 | Post | |
| 6,155,084 | A | 12/2000 | Andrews et al. | |
| 6,161,400 | A | 12/2000 | Hummel | |
| 6,260,344 | B1 * | 7/2001 | Chakravarti | 57/230 |
| 6,266,951 | B1 * | 7/2001 | Chakravarti | 57/210 |
| 6,279,305 | B1 * | 8/2001 | Hummel | 57/210 |
| 6,341,483 | B1 * | 1/2002 | Kolmes et al. | 57/249 |
| 6,349,531 | B1 * | 2/2002 | Kolmes et al. | 57/229 |
| 6,351,932 | B1 * | 3/2002 | Hummel | 57/210 |
| 6,363,703 | B1 * | 4/2002 | Kolmes | 57/210 |
| 6,381,940 | B1 * | 5/2002 | Kolmes et al. | 57/245 |
| 6,413,636 | B1 * | 7/2002 | Andrews et al. | 428/377 |
| 6,460,192 | B2 * | 10/2002 | Kindler | 2/167 |
| 6,467,251 | B1 * | 10/2002 | Kolmes | 57/230 |
| RE38,136 | E * | 6/2003 | Kolmes | 57/212 |
| 6,581,366 | B1 * | 6/2003 | Andrews | 57/225 |
| 6,701,703 | B2 * | 3/2004 | Patrick | 57/229 |
| 6,779,330 | B1 * | 8/2004 | Andrews et al. | 57/210 |
| 6,826,898 | B1 * | 12/2004 | Hummel | 57/210 |
| 6,978,643 | B2 * | 12/2005 | Akers et al. | 66/170 |
| 7,111,445 | B2 * | 9/2006 | Threlkeld et al. | 57/229 |
| 7,121,077 | B2 * | 10/2006 | Andrews et al. | 57/210 |
| 7,178,323 | B2 * | 2/2007 | Kolmes et al. | 57/210 |
| 7,332,196 | B2 * | 2/2008 | Kosuge et al. | 427/387 |
| 2003/0074879 | A1 | 4/2003 | Patrick | |

* cited by examiner

CUT-RESISTANT GLOVES CONTAINING FIBERGLASS AND PARA-ARAMID

BACKGROUND OF INVENTION

1. Field of the Invention

This invention relates to improved constructions of cut-resistant knitted gloves containing glass filaments and para-aramid fiber. The gloves have improved comfort and abrasion resistance in part because of the addition of a mobile companion yarn in the knit structure.

2. Description of Related Art

Cut-resistant gloves are commercially available that are knit with para-aramid fiber yarns plated to such things as cotton, with the layer of cotton located on the inside of the glove next to the skin. The cotton helps improve the comfort of the glove because para-aramid fibers can be abrasive to the skin. U.S. Pat. No. 6,044,493 to Post discloses a protective material such as a glove comprising a plurality of cut-resistant strands and a plurality of elastic strands knitted together to form a plated knit in which the cut-resistant strands form the outer surface and the elastic strands form the inner surface of the material.

In an effort to improve the cut performance of cut-resistant yarns, materials with high hardness have been combined with cut-resistant yarns. U.S. Pat. No. 5,119,512 to Dunbar et al. discloses cut-resistant yarn, fabric and gloves made from a single yarn comprising at least one flexible cut-resistant fibrous material and at least another material having a high level of hardness. U.S. Pat. No. 6,161,400 to Hummel discloses cut-resistant fabric and gloves made from two different yarns, one that contains cut-resistant fiber and one that contains fibers having high hardness. One of the two yarns is located predominantly on the exterior of the glove and the other predominantly on the interior. Likewise, U.S. Pat. No. 5,965,223 to Andrews et al. discloses a protective fabric and glove that has, at a minimum, an outer layer made with a yarn composed of an abrasive material plated to an inner layer of inherently cut-resistant or high-tensile strength material.

Bare glass fiber, while having high hardness, is also very brittle, easily abraded, and is highly irritating to the skin. One solution to this skin irritation problem has been to use fiberglass in the form of what has generally been referred to as composite yarns or wrapped yarns; that is, filaments of glass fiber are covered by a plurality of helically wrapped yarns. Representative yarns and processes for making such yarns as disclosed, for example, in U.S. Pat. No. 5,628,172 to Kolmes et al. and U.S. Pat. No. 5,845,476 to Kolmes. These wrappings generally are closely spaced and/or tightly wrapped around the core fiberglass filaments so as to get good coverage, but the unintended result is these composite or wrapped yarns tend to be stiff.

Further, such wrapped yarns help prevent skin irritation as long as the composite yarns remained undamaged. Unfortunately, during normal use, such gloves get nicks and abrasions that uncover the fiberglass which can irritate the skin even though the gloves remain useable.

Therefore what is needed is an improved glove construction for improved comfort and abrasion resistance during normal use.

BRIEF SUMMARY OF THE INVENTION

This invention relates to a cut-resistant knit glove comprising a) cut-resistant composite yarn having a core yarn and at least one first wrapping yarn helically wrapped around the core yarn, the core yarn including at least one 50 to 200 denier (56 to 220 dtex) glass fiber filament yarn and the first wrapping yarn being one 100 to 600 denier (110 to 680 dtex) para-aramid yarn;

b) companion yarn selected from the group consisting of aliphatic polyamide, polyester, and mixtures thereof; and c) lining yarn comprising a composite yarn of from 100 to 500 denier (110 to 560 dtex), the composite yarn having an elastomeric yarn core comprising at least one elastomeric yarn and at least one second wrapping yarn helically wrapped around the yarn core, the second wrapping yarn including at least one 20 to 300 denier (22 to 340 dtex) yarn selected from the group consisting of aliphatic polyamide, polyester, natural fibers, cellulosic fibers, and mixtures thereof;

wherein the cut-resistant composite yarn, the companion yarn, and the lining yarn are co-knit in the glove with the lining yarn plated on the interior of the glove and the cut-resistant composite yarn and companion yarn forming the exterior of the glove.

In one embodiment, this invention relates to a cut-resistant knit glove comprising a) cut-resistant composite yarn having a core yarn and at least one first wrapping yarn helically wrapped around the core yarn, the core yarn including at least one 50 to 200 denier (56 to 220 dtex) glass fiber filament yarn and the first wrapping yarn being one 100 to 600 denier (110 to 680 dtex) para-aramid yarn;

b) companion yarn selected from the group consisting of aliphatic polyamide, polyester, and mixtures thereof; and c) lining yarn comprising a composite yarn of from 100 to 500 denier (110 to 560 dtex), the composite yarn having a spandex yarn core comprising at least one spandex yarn, said yarn core having a linear density of up to 75 denier (84 dtex), and at least one second 20 to 300 denier (22 to 340 dtex) wrapping yarn comprising aliphatic polyamide, polyester, natural fibers, cellulosic fibers, and mixtures thereof, said at least one second wrapping yarn helically wrapped around the yarn core; wherein the cut-resistant composite yarn, the companion yarn, and the lining yarn are co-knit in the glove with the lining yarn plated on the interior of the glove and the cut-resistant composite yarn and companion yarn forming the exterior of the glove.

DETAILED DESCRIPTION OF THE INVENTION

Figure 1:
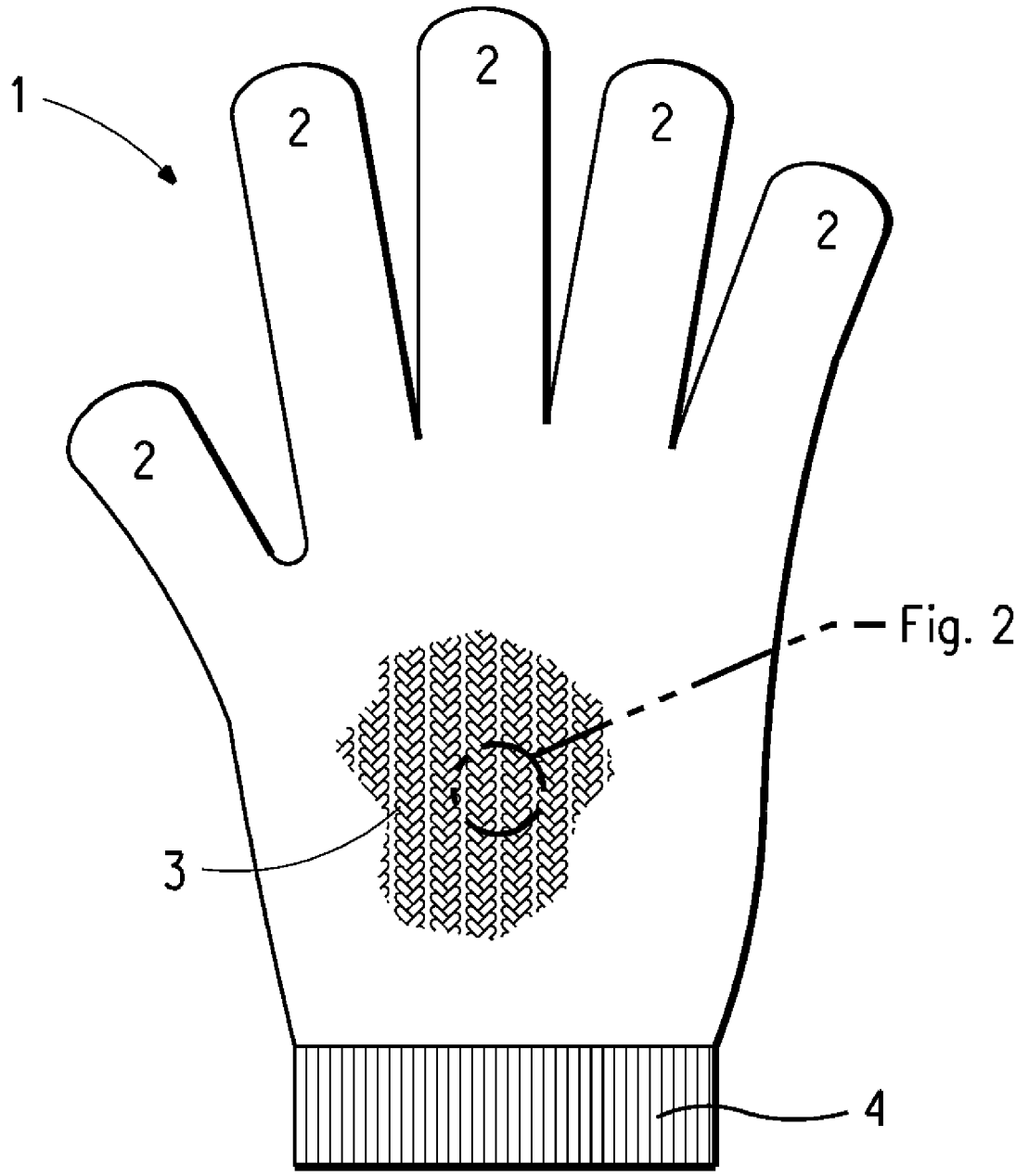
FIG. 1 is a representation of a cut-resistant glove made by knitting yarns using a glove knitting machine.

This invention relates to a cut-resistant knit glove construction comprising at least three types of yarns. These yarns include a cut-resistant composite yarn containing fiberglass, a companion yarn, and a liner yarn that are co-knit together with the lining yarn plated on the interior of the glove.

Cut-Resistant Composite Yarn

The cut-resistant composite yarn has a core comprising at least one core yarn of glass fiber filament yarn having a linear density of from 50 to 200 denier (56 to 220 dtex). It is thought a denier less than 50 denier (56 dtex) does not provide adequate cut protection, while a denier greater than 200 (220 dtex) results in a thicker fabric than is desired. In some preferred embodiments, the final glove size is 13 gauge or thinner, and in some embodiments the glass fiber filament yarn has a linear density of from 50 to 120 denier (56 to 130 dtex).

The terms glass fiber and fiberglass are used interchangeably herein to mean glass fiber filament yarn. Glass fiber is formed by extruding molten silica-based or other formulation glass into thin strands or filaments with diameters suitable for textile processing. Two types of fiberglass commonly used are referred to as S-glass and E-glass. E-glass has good insulation properties and will maintain its properties up to 1500 degrees F. (800 degrees C.). S-glass has a high tensile strength and is stiffer than E-glass. Suitable glass fiber is available from B&W Fiber Glass, Inc. and a number of other glass fiber manufacturers. In some embodiments, the use of E-glass is preferred in the cut-resistant composite yarn.

At least one additional yarn is then helically wrapped around the fiberglass core yarn that is a para-aramid yarn having a linear density of from 100 to 600 denier (110 to 680 dtex). Para-aramid fibers are made from an aramid polymer wherein the two rings or radicals are para oriented with respect to each other along the molecular chain. Methods for making para-aramid fibers are generally disclosed in, for example, U.S. Pat. Nos. 3,869,430; 3,869,429; and 3,767,756. Such aromatic polyamide organic fibers and various forms of these fibers are available from E. I. du Pont de Nemours & Company, Wilmington, Del. sold under the trademark Kevlar® fibers and from Teijin Ltd. of Japan sold under the trademark Twaron® fibers. For the purposes herein, Technora® fiber, which is available from Teijin Ltd. of Tokyo, Japan, and is made from copoly(p-phenylene/3,4'diphenyl ester terephthalamide), is considered a para-aramid fiber. In some embodiments, the para-aramid yarn comprises staple fibers, in some embodiments the para-aramid yarn comprises continuous filaments. In some embodiments, the para-aramid is poly(paraphenylene terephthalamide).

In some embodiments, the para-aramid yarn is wrapped around the core yarn at a frequency of 5 to 20 turns per inch (2 to 8 turns per cm). A higher frequency than 20 turns per inch (8 turns per cm) will result it a very stiff yarn and a lower frequency than 5 turns per inch (2 turns per cm) will hurt the durability of the glove in that the glass fiber filament core will not be fully covered. In some embodiments, the wrapping yarn is a spun staple yarn, in some other embodiments the wrapping yarn is a continuous filament yarn. In some preferred embodiments, the wrapping yarn is a textured continuous filament yarn.

Since two highly cut resistant yarns are used in the cut-resistant composite yarn, the cut-resistant composite yarn provides the primary cut resistance to the glove. In some preferred embodiments the cut-resistant composite yarn consists solely of only one core yarn of fiberglass and one wrapping yarn of para-aramid fiber, particularly poly(paraphenylene terephthalamide) fiber.

Companion Yarn

While the cut-resistant composite yarn can include a plurality of wrapping yarns about the core yarns, only one yarn is preferred due to stiffness imparted to the cut-resistant composite yarn, caused by multiple tight helical wrappings of the yarn about the cores. Instead, additional protection from the potential irritation from the fiberglass of the cut-resistant composite yarn is provided by a companion yarn knit with the cut-resistant composite yarn that helps randomly cover the cut-resistant composite yarn. The companion yarn is selected from the group consisting of aliphatic polyamide, polyester, and mixtures thereof. The companion yarn also provides lubricity to the yarn bundle knitted in the glove, allowing the knitted yarns more mobility in the knitted structure. In some embodiments the linear density of the companion yarn is 100 to 300 denier (110 to 340 dtex). This yarn size range allows for improved comfort and abrasion resistance without substantially decreasing the cut-resistance of the glove fabric. In some preferred embodiments, the companion yarn consists solely of a single type of yarn, such as an aliphatic polyamide yarn or a polyester yarn. In some embodiments, the companion yarn can be singles yarns; in some embodiments the companion yarn can be double or plied yarns. In some embodiments the companion yarn is a spun staple yarn, in some other embodiments the companion yarn is a continuous filament yarn. In some preferred embodiments, the companion yarn is a textured continuous filament yarn.

Lining Yarn

The third yarn component in the knitted glove provides a layer of a looped lining yarn next to the skin. The lining yarn is a composite yarn, having a total yarn linear density of from 100 to 500 denier (110 to 560 dtex) and having an elastomeric yarn core comprising at least one elastomeric yarn and at least one wrapping yarn helically wrapped around the yarn core. The wrapping serves to protect the somewhat less durable elastomeric yarn from abrasion during knitting and in use in the glove. In some preferred embodiments, the composite yarn contains solely apparel staple fiber yarns, that is, yarns used in traditional wearing apparel, such as aliphatic polyamide fibers, polyester fibers, natural fibers, cellulosic fibers, and mixtures thereof. In some embodiments, the wrapping yarn consists solely of a single type of yarn. In some embodiments, the wrapping yarn can be singles yarns; in some embodiments the wrapping yarn can be double or plied yarns. In some embodiments, the wrapping yarn is a spun staple yarn, in some other embodiments the wrapping yarn is a textured continuous filament yarn.

In some embodiments, the elastomeric yarn has a linear density of from 20 to 100 denier (22 to 110 dtex). In some embodiments, the elastomeric yarn has a linear density of 75 denier (84 dtex) or less, and in some preferred embodiments it has a linear density of 30-50 denier (33 to 56 dtex). In some embodiments, the elastomeric yarn is a spandex yarn. While in some embodiments the preferred elastomeric fiber yarn is a spandex fiber yarn, any fiber generally having stretch and recovery can be used. As used herein, "spandex" has its usual definition, that is, a manufactured fiber in which the fiber-forming substance is a long chain synthetic polymer composed of at least 85% by weight of a segmented polyurethane. Among the segmented polyurethanes of the spandex type are those described in, for example, U.S. Pat. Nos. 2,929,801; 2,929,802; 2,929,803; 2,929,804; 2,953,839; 2,957,852; 2,962,470; 2,999,839; and 3,009,901.

The at least one yarn helically wrapped around the elastomeric yarn core has a linear density of from 20 to 300 denier (22 to 340 dtex) and is selected from the group consisting of aliphatic polyamide, polyester, natural fibers, cellulosic fibers, and mixtures thereof. In some embodiments, the yarn is wrapped around the elastomeric yarn core at a frequency of 5 to 20 turns per inch (2 to 8 turns per cm). A higher frequency than 20 turns per inch (8 turns per cm) will result in a stiffer yarn than desired and a lower frequency than 5 turns per inch (2 turns per cm) will not adequately cover the elastomeric yarn core.

Glove

The glove is constructed such that the lining yarn is plated during knitting on the interior of the glove, while the cut resistant composite yarn and companion yarn are plated during knitting on the exterior of the glove. Construction of the glove in this manner provides several advantages. The wearer of the glove is thus provided with improved protection from the cut resistant composite yarn in two ways, first by the lining yarn that contacts the skin of the wearer and separates the cut resistant yarn from the skin, and second by the companion yarn, which is randomly positioned between the lining yarn and the cut resistant composite yarn throughout the glove.

Figure 2:
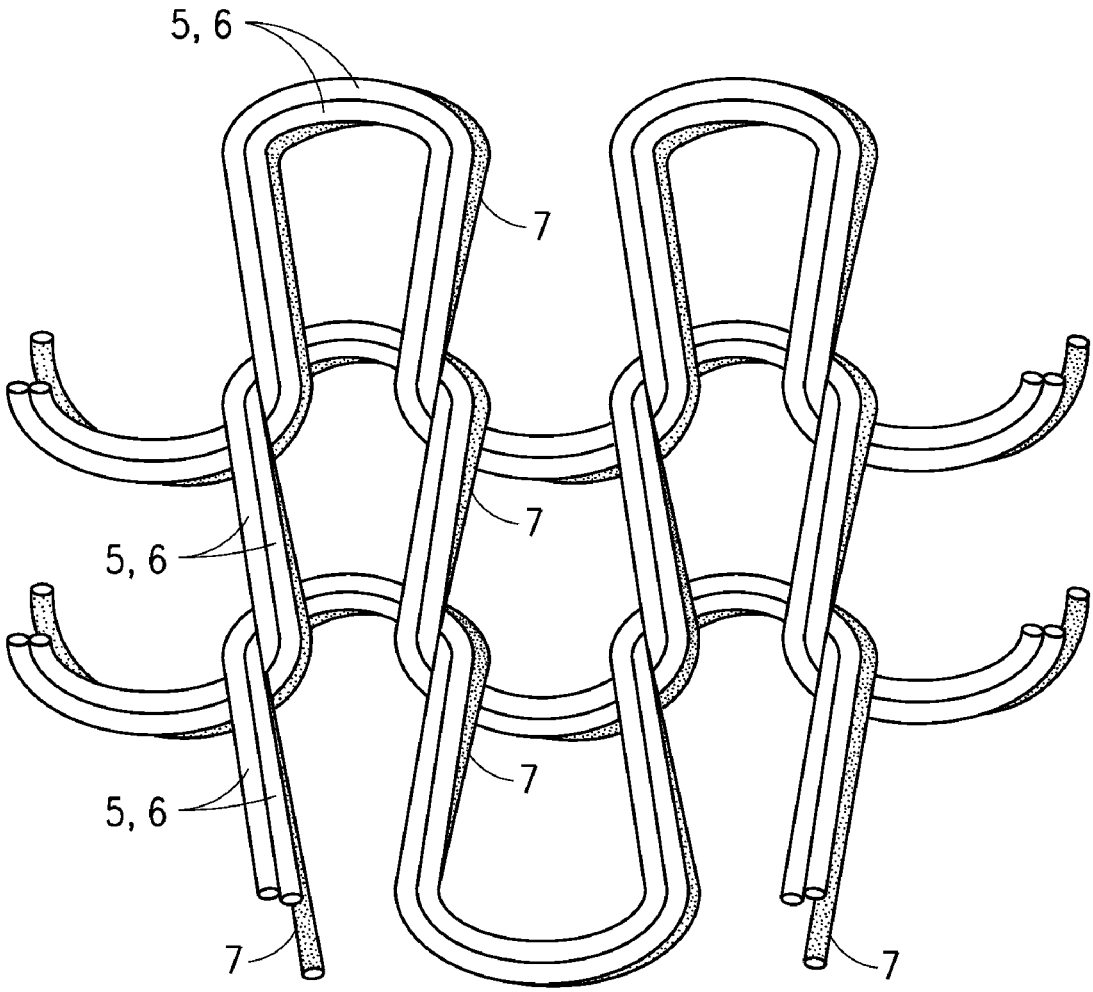
FIG. 2 is a representation of the cut-resistant composite yarn, companion yarn and lining yarn in the cut-resistant glove of FIG. 1.

FIG. 2 illustrates the knitted construction of the fabric with 5 representing the cut resistant composite yarn, 6 representing the companion yarns and 7 representing the lining yarn. As previously described the lining yarn is plated on the interior of the glove and the cut-resistant composite yarn and lining yarn forming the exterior of the glove.

For improved comfort, in preferred embodiments the companion yarn is not pre-assembled with the cut-resistant composite yarn prior to forming the exterior of the glove. This allows the companion yarn and the cut-resistant composite yarn to shift in relationship to each other on a localized scale. In the preferred embodiment, the companion yarn and the cu-resistant composite yarn are not restricted from moving against one another longitudinally within the layer along the surfaces of the yarn because they are not joined or twisted together in the fabric, but can move in relation to each other for improved comfort and abrasion resistance.

Further, the companion yarn and the cut-resistant composite yarn lie in the same knit layer in the glove but can move locally within that layer to shift either to the exterior or the interior of the layer; that is, the two yarns are knit such that the companion yarn is not preferentially located in the glove fabric either to the interior of the cut-resistant composite yarn in the glove or to the exterior of the cut-resistant composite yarn in the glove, but is randomly distributed over the exterior, the interior, and beside the cut-resistant composite yarn. This allows the companion yarn to provide both additional abrasion resistance to cut-resistant composite yarn from the outside of the glove while also providing additional cover from the cut-resistant composite yarn to the inside of the glove, adding additional protection to the wearer.

In some preferred embodiments, the entire glove, with the exception of any special treatment for the cuff, is knitted using the combination of cut-resistant composite yarn, companion yarn, and lining yarn. That is, as shown in the Figure, the entire surface of all finger stalls 2 of the glove 1, and the tubular portion 3 of the glove that forms the palm, sides, and back of the glove, are formed from a combination of yarns consisting of the cut-resistant composite yarn, companion yarn, and the lining yarn. Typically, the sleeve or cuff 4 of the glove can have additional elastomeric yarn to if desired; if the cuff is different, it still comprises the three yarn combination plus any additional gripping or sealing yarns or features.

In one embodiment, the gloves are very suitable when a lightweight cut-resistant glove having improved dexterity is needed. In particular, the gloves are useful in handling small objects having sharp edges. In some embodiments, the glove has a knit fabric basis weight for from 7 to 14 ounces per square yard (240 to 475 grams per square meter). In some embodiments, the gloves have a cut resistance index of 100 grams force per ounce per square yard of fabric (3 grams force per gram per square meter of fabric) or higher.

Process for making Gloves

In one embodiment, a glove can be made by first assembling the individual yarns used in the glove and creating a first bobbin of cut-resistant composite yarn, a second bobbin of companion yarn, and a third bobbin of lining yarn. The yarns from the three individual bobbins are then co-knit directly, essentially in one step, into a glove using commercially available glove knitting machines, such as those made by Shima Seiki Corporation. These machines can knit completed gloves from the individual yarns. In a preferred embodiment, the individual yarns are fed to the knitting machine without plying or otherwise combining the yarns. The liner yarn is fed into the knitter and held in such a way that is in front of the cut-resistant and companion yarns when the yarns are knitted so that the liner yarn it plated throughout the inside surface of the glove. The resulting glove has a mixture of cut-resistant and companion yarns throughout the outside surface of the glove and the liner yarn throughout the inside surface of the glove.

Coated Gloves

If additional gripping performance is desired for the glove, a flexible polymer coating can be provided to the glove. In some embodiments, the glove is provided with an exterior synthetic polymer coating selected from the group consisting of nitrile, latex, polyurethane, neoprene, rubber, and mixtures thereof. Generally, such coatings are applied by dipping the glove or a portion of the glove into a polymer melt or solution and then curing the coating.

Test Methods

Cut Resistance. The method used is the "Standard Test Method for Measuring Cut Resistance of Materials Used in Protective Clothing", ASTM Standard F 1790-97. In performance of the test, a cutting edge, under specified force, is drawn one time across a sample mounted on a mandrel. At several different forces, the distance drawn from initial contact to cut through is recorded and a graph is constructed of force as a function of distance to cut through. From the graph, the force is determined for cut through at a distance of 25 millimeters and is normalized to validate the consistency of the blade supply. The normalized force is reported as the cut resistance force. The cutting edge is a stainless steel knife blade having a sharp edge 70 millimeters long. The blade supply is calibrated by using a load of 400 g on a neoprene calibration material at the beginning and end of the test. A new cutting edge is used for each cut test. The sample is a rectangular piece of fabric cut 50×100 millimeters on the bias at 45 degrees from both the warp and fill. The mandrel is a rounded electro-conductive bar with a radius of 38 millimeters and the sample is mounted thereto using double-face tape. The cutting edge is drawn across the fabric on the mandrel at a right angle with the longitudinal axis of the mandrel. Cut through is recorded when the cutting edge makes electrical contact with the mandrel. As reported herein, the index is preferably reported as the cut through force in grams divided by the basis weight in ounces per square yard, but conversion to SI units is easily accomplished.

Abrasion Performance. The abrasion performance of fabrics is determined in accordance with ASTM D-3884-01 "Standard Guide for Abrasion Resistance of Textile Fabrics (Rotary Platform, Double Head Method)". The number of cycles to abrade the knit fabric to the first hole is recorded as the abrasion resistance of the glove fabric.

Example

A cut-resistant glove was made in the following manner. A bobbin of cut-resistant composite yarn was made having a longitudinal core of 110 dtex (100 denier) E fiberglass wrapped with one a 295 dtex (266 denier or 20/1 cotton count) poly(paraphenylene terephthalamide) staple spun yarn at a frequency of 7 turns per inch (3 turns per cm) of core. A bobbin of lining yarn was made having a longitudinal core of 40 denier spandex plied with a 295 dtex (266 denier or 20/1 cotton count) polyester staple fiber yarn. The core was wrapped with one wrapping of a 44 dtex (40 denier) textured continuous filament nylon yarn at a frequency of 7 turns per inch (3 turns per cm) of core. Yarns from these two bobbins of yarns, along with a yarn from a bobbin of companion yarn of 167 dtex (150 denier) textured continuous filament polyester yarn, were fed, without any prior assembly (i.e. plying, twisting) of the yarns into a Shima Seiki 13-gauge automatic glove knitting machine having plating capability. A glove was made with the lining yarn plated on the interior of the glove and the cut-resistant composite yarn and the companion yarn on the exterior of the glove. Glove properties are shown in the Table.

TABLE

| Basis Weight grams/m$^2$ (oz/yd$^2$) | Cut Resistance Index (grams/oz/yd$^2$)) | Abrasion Resistance (cycles) |
|---|---|---|
| 430 (12.7) | 107 | 386 |

What is claimed is:

1. A cut-resistant knit glove comprising:

a) cut-resistant composite yarn having a core yarn and at least one first wrapping yarn helically wrapped around the core yarn, the core yarn including at least one 50 to 200 denier (56 to 220 dtex) glass fiber filament yarn and the first wrapping yarn being one 100 to 600 denier (110 to 680 dtex) para-aramid yarn;

b) companion yarn selected from the group consisting of aliphatic polyamide, polyester, and mixtures thereof; and c) lining yarn comprising a composite yarn of from 100 to 500 denier (110 to 560 dtex), the composite yarn having an elastomeric yarn core comprising at least one elastomeric yarn and at least one second wrapping yarn helically wrapped around the yarn core, the second wrapping yarn including at least one 20 to 300 denier (22 to 340 dtex) yarn selected from the group consisting of aliphatic polyamide, polyester, natural fibers, cellulosic fibers, and mixtures thereof; and wherein the cut-resistant composite yarn, the companion yarn, and the lining yarn are co-knit in the glove with the lining yarn plated on the interior of the glove and the cut-resistant composite yarn and companion yarn forming the exterior of the glove.

2. The cut-resistant knit glove of claim 1 wherein the para-aramid yarn comprises staple fibers or continuous filaments.

3. The cut-resistant knit glove of claim 1 wherein the para-aramid is poly(paraphenylene terephthalamide).

4. The cut-resistant knit glove of claim 1 wherein the elastomeric yarn is a spandex yarn.

5. The cut-resistant knit glove of claim 1 wherein the elastomeric yarn has a linear density of up to 100 denier (110 dtex).

6. The cut-resistant knit glove of claim 1 further having a cut resistance index of 100 grams force per ounce per square yard of fabric (3390 grams force per gram per square meter of fabric) or higher.

7. The cut-resistant knit glove of claim 6 having a knit fabric basis weight of from 7 to 14 ounces per square yard (240 to 475 grams per square meter).

8. The cut-resistant knit glove of claim 1 further comprising an exterior synthetic polymer coating selected from the group consisting of nitrile, latex, polyurethane, neoprene, rubber, and mixtures thereof.

9. A cut-resistant knit glove comprising:

a) cut-resistant composite yarn having a core yarn and at least one first wrapping yarn helically wrapped around the core yarn, the core yarn including at least one 50 to 200 denier (56 to 220 dtex) glass fiber filament yarn and the first wrapping yarn being one 100 to 600 denier (110 to 680 dtex) poly(paraphenylene terephthalamide) yarn;

b) companion yarn selected from the group consisting of aliphatic polyamide, polyester, and mixtures thereof; and c) lining yarn comprising a composite yarn of from 100 to 500 denier (110 to 560 dtex), the composite yarn having a spandex yarn core comprising at least one spandex yarn, said yarn core having a linear density of up to 75 denier (84 dtex), and at least one second 20 to 300 denier (22 to 340 dtex) wrapping yarn selected from the group consisting of aliphatic polyamide, polyester, natural fibers, cellulosic fibers, and mixtures thereof, said at least one second wrapping yarn helically wrapped around the yarn core;

wherein the cut-resistant composite yarn, the companion yarn, and the lining yarn are co-knit in the glove with the lining yarn plated on the interior of the glove and the cut-resistant composite yarn and companion yarn forming the exterior of the glove.

10. The cut-resistant knit glove of claim 9 further having a cut resistance index of 100 grams force per ounce per square yard of fabric (3 grams force per gram per square meter of fabric) or higher.

11. The cut-resistant knit glove of claim 10 having a knit fabric basis weight of from 7 to 14 ounces per square yard (240 to 475 grams per square meter).

12. The cut-resistant knit glove of claim 11 further comprising an exterior synthetic polymer coating selected from the group consisting of nitrile, latex, polyurethane, neoprene, rubber, and mixtures thereof.

* * * * *